US007878105B2

(12) United States Patent
More

(10) Patent No.: US 7,878,105 B2
(45) Date of Patent: Feb. 1, 2011

(54) MITIGATING RECOIL IN A BALLISTIC ROBOT

(76) Inventor: Grinnell More, 4 Elliott St., Nashua, NH (US) 03064

( * ) Notice: Subject to any disclaimer, the term of this patent is extended or adjusted under 35 U.S.C. 154(b) by 350 days.

(21) Appl. No.: 12/061,476

(22) Filed: Apr. 2, 2008

(65) Prior Publication Data

US 2011/0000363 A1 Jan. 6, 2011

Related U.S. Application Data

(60) Provisional application No. 60/909,630, filed on Apr. 2, 2007.

(51) Int. Cl.
*F41A 25/10* (2006.01)

(52) U.S. Cl. ..... 89/43.01

(58) Field of Classification Search ..... 89/42.01, 89/43.01, 44.01, 44.02
See application file for complete search history.

(56) References Cited

U.S. PATENT DOCUMENTS

| | | | | | |
|---|---|---|---|---|---|
| 2,582,140 | A * | 1/1952 | Leek | 89/44.01 |
| 2,778,278 | A * | 1/1957 | Schwager et al. | 89/42.01 |
| 2,790,357 | A * | 4/1957 | Garrett | 89/43.01 |
| 3,004,475 | A * | 10/1961 | Barr et al. | 89/1.801 |
| 3,672,255 | A * | 6/1972 | Findlay et al. | 89/42.01 |
| 3,969,982 | A * | 7/1976 | Pier-Amory et al. | 89/178 |
| 4,269,109 | A * | 5/1981 | Stoner | 89/198 |
| 4,656,921 | A | 4/1987 | Zierler | |
| H1010 | H | 1/1992 | Kasten et al. | |
| 5,555,919 | A | 9/1996 | Lipp | |
| 6,227,098 | B1 * | 5/2001 | Mason | 89/193 |
| 6,408,731 | B1 * | 6/2002 | Elsener | 86/50 |
| 6,578,464 | B2 | 6/2003 | Ebersole et al. | |
| 6,745,663 | B2 | 6/2004 | Ebersole et al. | |
| 6,748,844 | B2 * | 6/2004 | Ang | 89/37.05 |
| 6,789,456 | B2 | 9/2004 | DeRoos et al. | |
| 6,802,406 | B2 | 10/2004 | Martin | |
| 6,889,594 | B2 | 5/2005 | Ebersole et al. | |
| 2001/0006018 | A1 * | 7/2001 | Ang | 89/42.01 |
| 2003/0200862 | A1 * | 10/2003 | Ebersole et al. | 89/42.01 |
| 2006/0011056 | A1 | 1/2006 | Edwards et al. | |

OTHER PUBLICATIONS

TARDEC US Army TARDEC S Pan-Talon Assists Police Department Bomb Squad Units Jul. 27, 2005 2 pgs.

* cited by examiner

*Primary Examiner*—Bret Hayes
(74) *Attorney, Agent, or Firm*—Fish & Richardson P.C.

(57) ABSTRACT

Recoil mitigating devices and methods for use with projectile firing systems such as a disrupter mounted to a robotic arm. A pair of parallel spring provides dampening of axial recoil movement of the disrupter relative to the robotic arm. Forward ends of the springs are attachable to the barrel of the disrupter while rearward portions of the springs are attachable to the robotic arm by a robot mount block. The robot mount block at least partially encloses the barrel of the disrupter in connecting the parallel springs and permits axial movement of the disrupter along or through the mount during firing.

8 Claims, 10 Drawing Sheets

MITIGATING RECOIL IN A BALLISTIC ROBOT

CROSS-REFERENCE TO RELATED APPLICATIONS

This application claims priority under 35 U.S.C. §119(e) to U.S. provisional patent application Ser. No. 60/909,630, filed on Apr. 2, 2007, the entire contents of which are hereby incorporated by reference.

TECHNICAL FIELD

This invention relates to ballistic or projectile firing systems, and more particularly to devices and methods for mitigating recoil during operation of such systems.

BACKGROUND

Ballistic weapons or other projectile firing systems, typically generate recoil forces proportionate to the discharge forces or the mass and acceleration of the projectile. The resulting recoil impulse or "kick" corresponds to the recoil force integrated over time. A recoil mitigation device serves to attenuate or dampen the force-time profile during discharge, for example, to create a longer, lower amplitude recoil impulse.

Various mechanical means have been proposed for mitigating recoil of projectile firing systems. Known devices may be integrated into a firing system and may include hydraulics, pneumatics and friction brakes. Such systems are often complex, expensive, and applicable to a single firing system into which it is integrated. Many such systems position the mitigation device entirely to one side of the firing system and may thus cause binding of the mitigation device or firing system or pitching of the firing device due to the presence of resistance to recoil only from one side.

Recoil affects the targeting accuracy of the firing system and excessive recoil may injure an operator or damage the system or system support structure. Certain ballistic applications such as rocket launchers and Percussion Actuated Non-electric ("PAN") disrupters require both high discharge forces and a high degree of accuracy. These factors are particularly significant in the context of smaller (e.g., 80 lbs or less) EOD robotic platforms, such as the iRobot PackBot EODs, which are designed to be relatively lightweight. Disrupters are explosive ordnance disposal (EOD) tools designed to remotely disable and render-safe improvised explosive devices (IEDs) without initiating the IEDs. Conventional disrupters use blank shotgun shells and special modified loads or projectiles (i.e., liquid, solid shot or frangible loads) depending on the application or scenario. The disrupter can include a breech for loading the shell, a barrel, and a blasting cap, detonating cord, electrical shock tube initiator or other initiating device. For example, a water load may be used to open explosive packages and disrupt the explosives and firing train.

Certain disrupters have become commonplace in Explosive Ordnance Disposal (EOD) communities, including the PAN Disrupter noted above (one version manufactured by Ideal Products of Lexington, Ky. under license from Sandia National Laboratory) and the RE 12-12 disrupter. These disrupters are often used on a static mount or more recently on dynamic platforms such as on robot arms. In ordinary use, they are mounted on very stable, very robust mechanical platforms, which are not expected to move or otherwise articulate. Robotic arms can be articulated, electrically powered, not typically back-driveable, often light duty, and often not suited for use with standard disruptors.

Accordingly, there is a need for a recoil mitigation device for use with disrupters and various other ordnances mounted on robotic platforms. There is a need for a recoil mitigation device that minimizes binding or lateral pitching. There is also a need for a simple recoil mitigation device that is readily attachable to and detachable from various ordnances.

SUMMARY

The details of one or more embodiments of the invention are set forth in the accompanying drawings and the description below. Other features, objects, and advantages of the invention will be apparent from the description and drawings, and from the claims.

In one example a disrupter is mounted on a robotic arm of an EOD robot and a recoil mitigation device ("RMD") or "recoilless mount" serves to mitigate recoil transferred from the barrel or body of the disrupter to the robotic arm or robot. One recoilless mount embodiment includes a pair of gas spring assemblies having gas cylinders and piston rods slideably received within the gas cylinders. The gas cylinders are attached to a robot mount block and the piston rods are attached by a barrel mount to the disrupter barrel forward of the robot mount. The gas spring assemblies are aligned parallel to and adjacent the disrupter barrel and the robot mount block defines an aperture, passage or other formation to provide clearance for axial movement of the barrel relative to the mount during discharge of the disrupter. The robot mount block can also serve as a bearing surface relative to the disrupter barrel to support and guide the disrupter as it travels relative to the robot mount block during the recoil mitigation cycle. The recoil forces are dampened through compression of the gases in the gas spring as the barrel recoils towards the robot mount block. The gas springs can be attached to the robot mount block at multiple points or can attach to multiple robot mounts to stabilize against pitching or rocking of the disrupter during discharge.

In another recoilless mount embodiment, a front barrel mount supports the forward ends of a pair of rails aligned substantially parallel to and adjacent the disrupter barrel while a rear barrel mount supports the rearward ends of the pair of rails. The recoilless mount attaches to the robot via a slidable rail carriage. Springs disposed along the rails bias the slidable rail carriage in a rearward position. The rails move through the carriage in response to the recoil forces of the disrupter barrel and opposed dampening forces of the springs. Compliant stops can be used at either end of the rails to limit movement of the carriage along the rails. The rail carriage is formed to attach to the rails on opposite sides of the barrel and includes an aperture, recess or other formation to provide clearance for axial movement of the barrel during discharge of the disrupter.

The recoilless mount can be readily adapted for use with various ordnances by fitting the recoilless mount with the appropriate barrel mounts for the selected ordnance. Additionally, the recoilless mount can be adjustable, for example by varying the spring or rail length, spring stiffness or adjusting other parameters for a given application.

One aspect of the invention features a disrupter recoil mitigation device for use with a robot support platform. In one embodiment, the device includes first and second gas spring assemblies mountable in substantially parallel alignment with a barrel of a disrupter with the first and second gas spring assemblies spaced to accommodate the barrel of the disrupter between the first and second gas spring assemblies. The first and second gas spring assemblies include a gas cylinder and a piston rod slideably received within the gas cylinder with a distal end of the piston rod extending outwardly from the gas cylinder. A disrupter mount is connected to one of the gas cylinder and the distal end of the piston rod and a robot mount block is connected to the other of the gas cylinder and the distal end of the piston rod. The robot mount block is configured to be mounted to a robotic support platform. The mount block at least partially encloses the barrel of a disrupter when the disrupter is mounted between the spring elements and permits axial disrupter movement during discharge of the disrupter.

In some cases, the robot mount block is connectable to a robotic arm.

In one embodiment, the disrupter mount is connectable to a forward section of a barrel of a disrupter.

In some cases, the disrupter mount comprises a barrel clamp configured to apply clamping forces to a disrupter barrel. The barrel clamp includes a barrel clamp base and a barrel clamp cap together defining complimentary clamping surfaces.

In one embodiment, the robot mount block includes opposing sides each defining a clamping surface for clamping the gas cylinder of one of the first and second gas spring assemblies, and further includes first and second robot mount block clamps attachable to the robot mount block to secure the first and second gas spring assemblies to the robot mount block.

In another embodiment, the device includes a supplemental support spaced apart from the robot mount block for supporting the first and second gas spring assemblies and to reduce pitching during discharge of the disrupter.

Another aspect of the invention features a projectile launcher recoil mitigation device for use with a robot support platform. In one embodiment, the device includes a rail assembly having first and second rails in substantially parallel alignment and each having a forward end and a rearward end. A rail slider carriage defines first and second rail apertures to receive the first and second rails respectively so as to be slidably moveable relative the first and second rails. The rail slider carriage is configured to at least partially enclose a disrupter between the first and second rails and is further configured to allow axial movement of the carriage along the disrupter barrel during recoil of the disrupter. First and second springs are disposed respectively along the first and second rails and configured to bias the carriage towards one of the first and second ends of the first and second rails and to compress to dampen recoil forces during discharge of a disrupter. A disrupter mount is connected to one of the rail assembly and the rail slider carriage. A robot mount is connected to the other of the rail assembly and the rail slider carriage.

In some cases, the disrupter mount is connectable to a PAN disrupter.

In some cases, the robot mount is connectable to a robotic arm.

In one embodiment, the disrupter mount comprises a barrel clamp configured to apply clamping forces to a disrupter barrel. In some cases, the barrel clamp comprises a barrel clamp base and a barrel clamp cap, together defining a cylindrical barrel clamping surface.

In another embodiment, the device includes a compliant stop connected to one of the rail assembly and the carriage to limit movement of the carriage along the rail assembly.

In another embodiment, the disrupter mount includes first and second barrel clamps attachable to the rail assembly at the first and second ends of the first and second rails.

In one implementation, a gas spring is attached to the carriage in parallel with the rail assembly to further dampen bi-directional movement of the carriage along the rail assembly.

Another aspect of the invention features, in combination, an ordnance disrupter and a disrupter recoil mitigation device. In one implementation, the disrupter recoil mitigation device includes first and second gas spring assemblies mountable in substantially parallel alignment with a barrel of a disrupter. The first and second gas spring assemblies are spaced to accommodate the barrel of the disrupter between the first and second gas spring assemblies. The first and second gas spring assemblies each comprise a gas cylinder and a piston rod slideably received within the gas cylinder with a distal end extending outwardly from the gas cylinder. A disrupter mount is connected to one of the gas cylinder and the distal end of the piston rod and a robot mount block is connected to the other of the gas cylinder and the distal end of the piston rod. The robot mount block is configured for mounting to a robotic support platform. The robot mount block is configured to at least partially enclose the barrel of a disrupter when the disrupter is mounted between the spring elements and to permit axial disrupter movement during discharge of the disrupter.

Another aspect of the invention features a method of mitigating recoil exerted on a robotic support platform during firing of a disrupter. In one application, the method includes mounting first portions of a pair of spring elements to the barrel of the disrupter, the spring elements being substantially parallel to the barrel; and the mounting second portions of the spring elements to the robotic support platform. The method includes biasing the barrel in a forward position relative to the robotic support platform and compressing the spring elements as the disrupter is discharged to mitigate recoil transfer to the robotic support platform.

In some applications, the spring elements are one of gas springs and coil springs.

In some applications, mounting the second portions of the spring elements includes positioning the barrel of the disrupter in a passage in a robot mounting block such that the barrel of the disrupter moves rearward through the passage during compression of the spring elements.

In other applications, mounting second portions of the spring elements includes supporting the spring elements at multiple axially spaced locations to resist pitching of the spring elements during discharge of the disrupter.

DESCRIPTION OF DRAWINGS

A more complete understanding of the present invention may be derived by referring to the detailed description and claims when considered in connection with the Figures, wherein like reference numerals refer to similar elements throughout the Figures.

DETAILED DESCRIPTION

A recoil mitigation device ("recoilless mount") provides dampening of recoil generated during discharge of a projectile from a projectile firing device such as a disrupter. In various embodiments, recoil damping is provided by a pair of gas shocks or gas springs interposed between the disrupter and the disrupter support platform. In other embodiments, recoil damping is provided by a pair of rails carrying coil springs and a rail carriage, the rails being connected to the disrupter barrel and the rail carriage being connected to the disrupter support platform.

Preferred embodiments may be used to mitigate recoil experienced by any support platform carrying a projectile firing device. That being said, the embodiments described herein are shown in the context of a disrupter mounted on a robotic arm. Thus, "disrupter" as used herein, generally includes any launcher, projectile firing device or ordnance. Similarly, "robot" and "robot arm" generally includes any non-human ordnance support platform.

Recoil from discharge of a water loaded disrupter typically ranges between 5-10 pounds-force-seconds while recoil from discharge of a metal slug load typically ranges between 4-7 pounds-force-seconds. Thus, disrupter recoil experienced by a robotic arm is of a higher magnitude than the typical 3 pounds-force-seconds generated by most human-borne weapons. In the context of an EOD robot, the PAN disrupter is positionable using a robotic arm with a series of arm lengths and articulated joints. Recoil during discharge of the disrupter causes the EOD robot to pitch or rock backwards during firing, reducing the accuracy or efficacy of the ordnance. Additionally, the robotic arms, joints or other robot platform elements can be damaged by unmitigated, repeated or excessive recoil.

Figure 1:
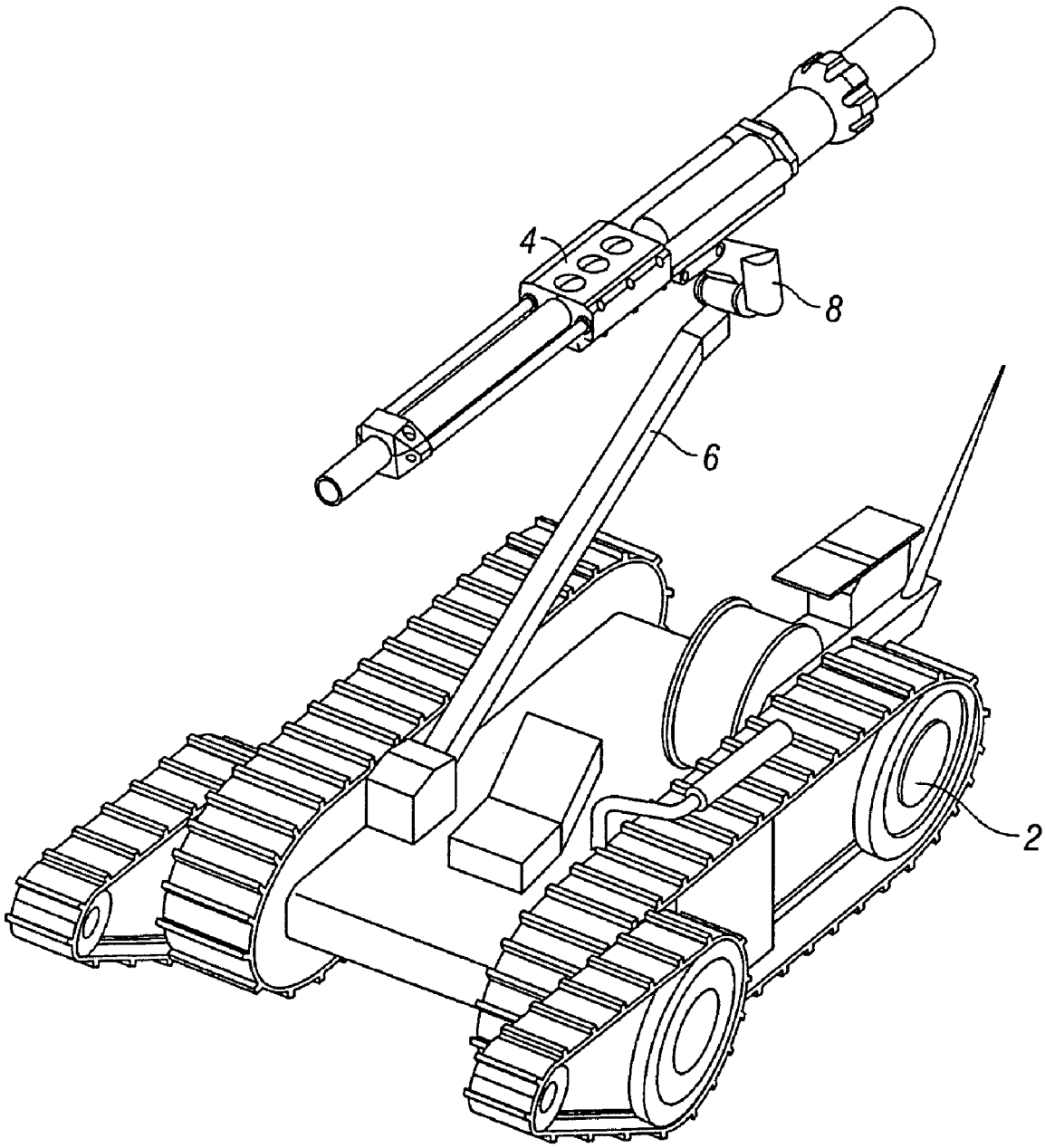
FIG. 1 is a perspective view of an EOD robot fitted with a disrupter according to one embodiment.

Turning now to the Figures, FIG. 1 is a perspective view of an EOD (explosive ordnance disposal) robot 2 fitted with a disrupter 4 according to one embodiment. The depicted robot 2 provides a remote mobile platform for positioning and operating disrupter 4. A robotic arm 6 extends from robot 2 and includes articulated joints 8, which provide multiple degrees of freedom for precise positioning of disrupter 4. Joints 8 may include controlled drive motors coordinated to accurately position the distal end of robotic arm 6 carrying disrupter 4.

Figure 2:
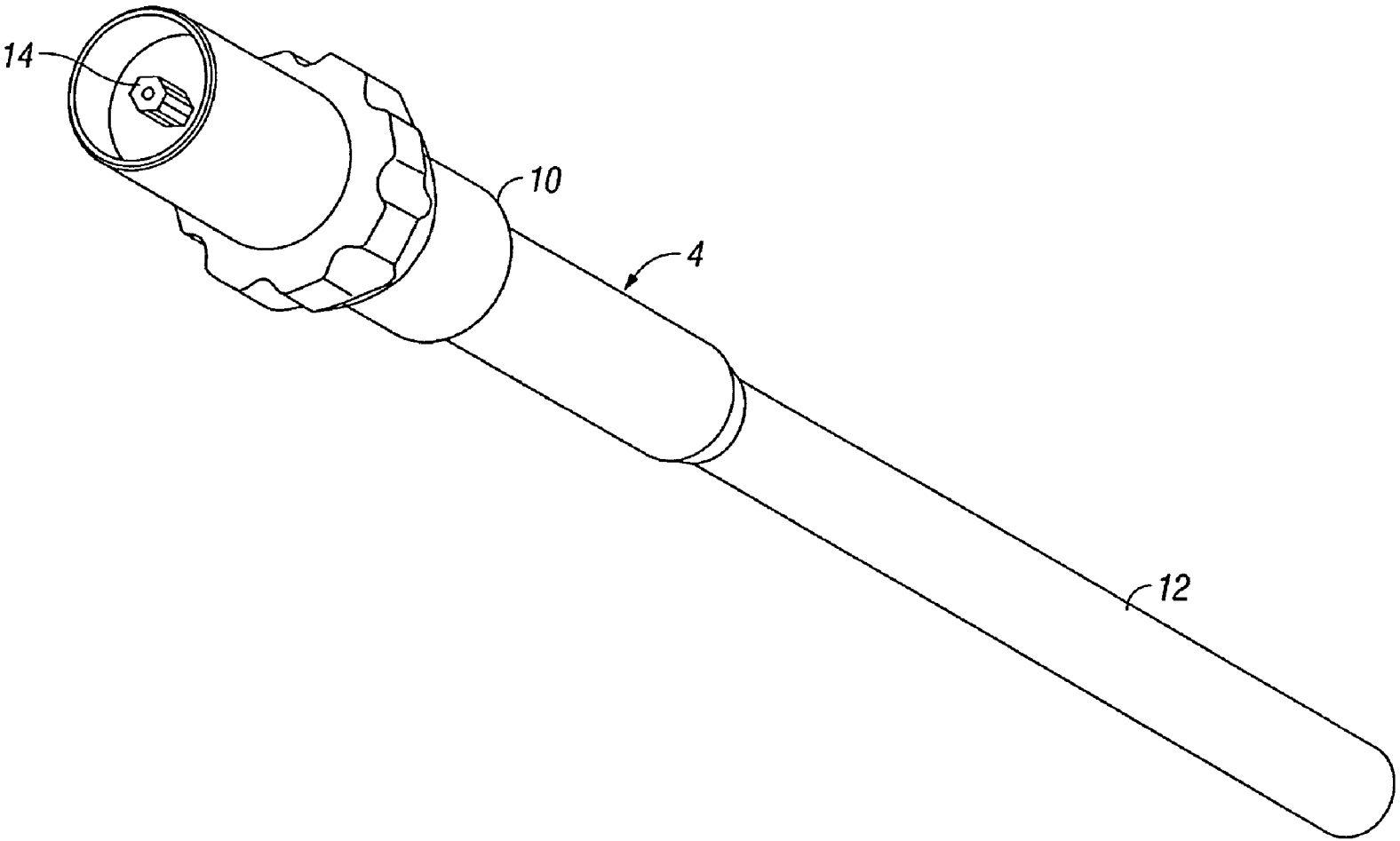
FIG. 2 is a perspective view of a disrupter.

FIG. 2 is a perspective view of a disrupter 4 having a breech 10 for loading a projectile to be discharged, a barrel 12 defining a central bore for passage of the projectile upon firing, and an initiator 14 for initiating firing or discharge of the projectile from an elongated barrel 12. An example of an explosives disruptor having such a design is the PAN (Percussion Actuated Non-electric) disrupter, designed by Sandia National Laboratories and available under the trademark PAN DISRUPTER™.

In use, as the projectile is discharged from barrel 12, disrupter 4 experiences a recoil impulse. Without recoil mitigation, the recoil impulse force is in turn exerted on robotic arm 6. The implementations disclosed herein help mitigate such recoil impulses.

Figure 3:
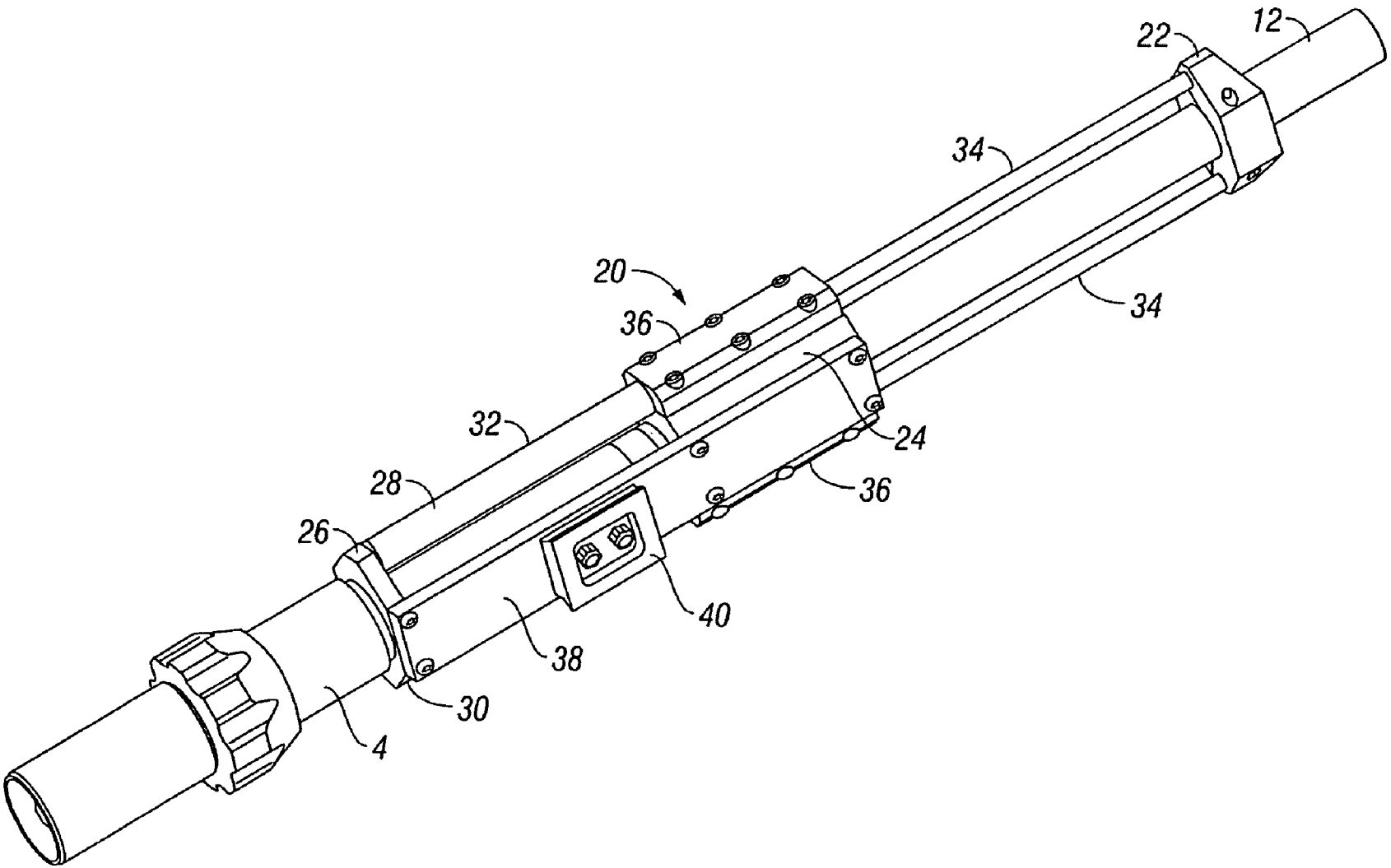
FIG. 3 is a perspective view of a disrupter and recoilless mount combination according to one embodiment.
Figure 4:
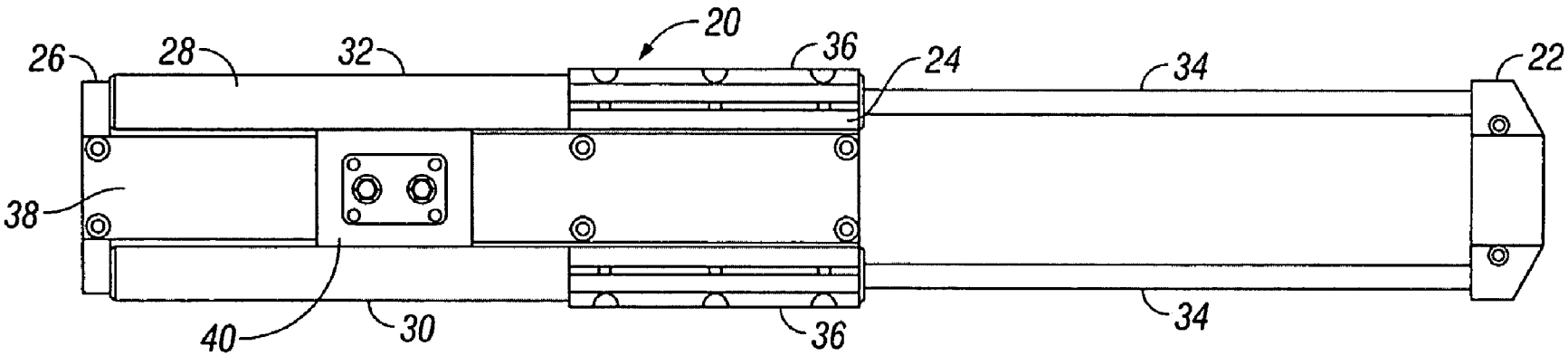
FIG. 4 is a perspective view of the recoilless mount of FIG. 3.

FIG. 3 is a perspective view of a disrupter and recoilless mount combination according to one embodiment. FIG. 4 is a bottom view of the recoilless mount of FIG. 3, without a disrupter attached. In the depicted combination, barrel 12 of disrupter 4 supports recoilless mount 20 with a forward barrel mount 22 and a robot mount block 24. Recoilless mount 20 includes first and second gas springs 28 and 30 comprising gas cylinders 32 and piston rods 34 slideably received within gas cylinders 32. The free or distal ends of piston rods 34 are attached to forward barrel mount 22. Gas cylinders 32 are secured to mount block 24 by mount block clamps 36.

Gas cylinders 32 are further stabilized by a rearward mount 26 spaced apart from mount block 24 and attached thereto by a connector plate 38. Alternatively, mount block 24 may be lengthened and gas cylinders 32 positioned and attached to provide suitable stability without the need for rearward mount 26. Mount block 24 is depicted here with connector plate 38 and a dove-tail bracket 40 for attachment to a complimentary dove-tailed recess bracket carried on robotic arm 6. Dove tail bracket 40 provides for rapid attachment and removal of disruptor 4 from robotic arm 6. This is particularly advantageous with single shot disrupters in a scenario requiring disruption of multiple explosive devices.

Gas springs 28 can be selected to provide a desired resistance or displacement of piston rod 34 within gas cylinder 32. For example, higher pressure, higher volume or longer gas spring 28 can be advantageous in applications requiring higher load ordnances. In other embodiments, gas springs 28 can be replaced with coil springs or other mechanical, electrical or magnetic biasing or resistance devices.

Forward barrel mount 22 comprises two complimentary portions of a cylindrical surface, i.e., a clamp base and a clamp cap, and is attachable to barrel 12 by clamping the base and cap. In another embodiment, barrel mount 22 is an integral slotted annulus slidable over the forward end of barrel 12 and attachable thereto by closure of a slot, e.g., through tightening of a fastener, to generate suitable clamping forces. Additionally, any other means of attaching forward barrel mount 22 to barrel 12 can be used. Barrel mount 22 can be affixed to any suitable part of a launcher or ordnance.

Rearward mount 26 serves to affix the rearward ends of gas springs 28 and 30 together substantially parallel to barrel 12. Unlike forward barrel mount 22, rearward mount 26 need not be clamped to barrel 12, but can define a passage to allow movement of barrel 12 through rearward mount 26 as recoil of barrel 12 drives piston rods 34 slidably into gas cylinders 32. It is understood that gas springs 28 and 30 can be end-turned and the respective attachment points to forward mount 22 and robot mount block 24 interchanged and still provide suitable sliding operation of gas cylinders 28 and 30.

Accordingly, reversal or exchange of any number of sliding elements, mounts, or other elements described herein may be accomplished within the scope of the present invention.

The various structural mounts, bracketry, or other structural elements described herein may be constructed from a wide variety of materials including, but not necessarily limited to, aluminum, steel, high strength plastics or other suitable metal or non-metal materials.

Figure 5:
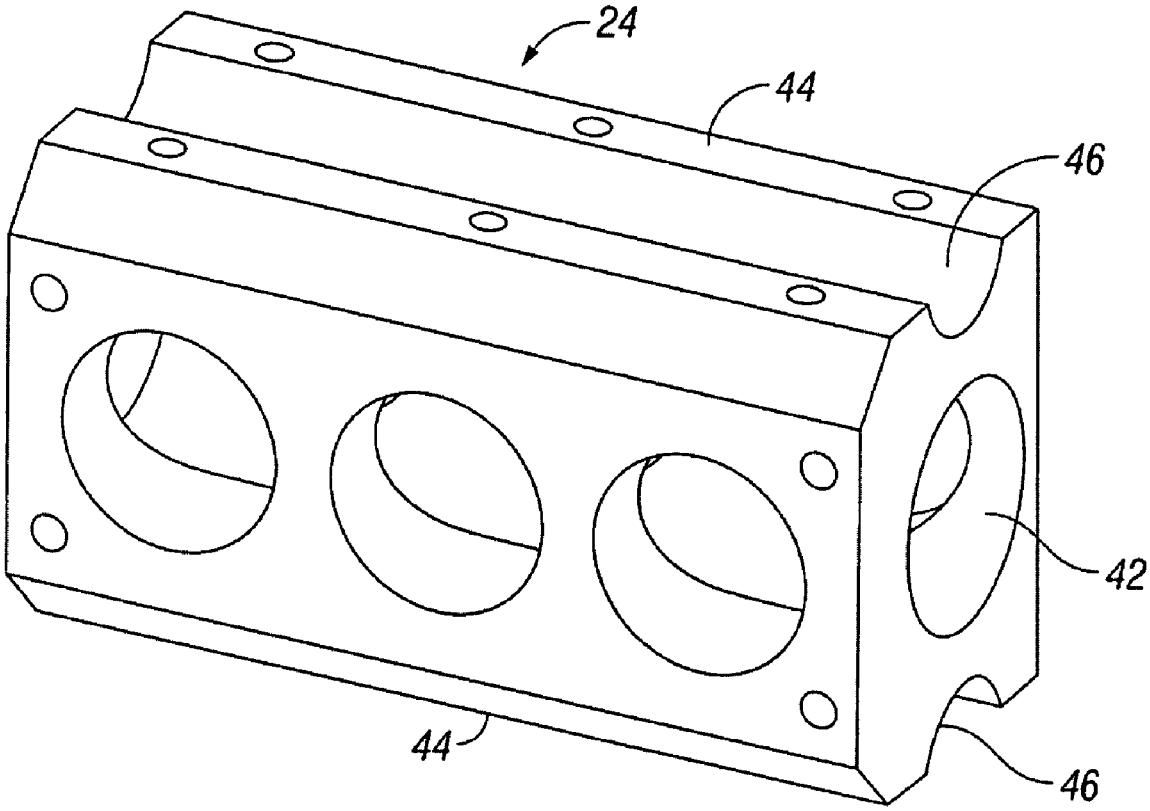
FIG. 5 is a perspective view of a robot mount block.

FIG. 5 is a perspective view of a robot mount block 24. In this implementation, mount block 24 includes opposing lateral sides 44 defining recessed clamping surfaces 46 for receiving a portion of gas springs 28 and 30. Mount block clamps 36 attach to mount block 24 along sides 44 to secure gas springs 28 and 30. Mount block 24 further defines a central barrel passage 40 sized to allow axially rearward movement of barrel 12 as recoil of barrel 12 drives piston rods 34 slidably into gas cylinders 32. Additional recesses or passages may be formed in mount block 24 as necessary for receipt of fasteners inserted through mount block clamps 36 or plate 38 or to reduce the weight of mount block 24.

Mount block 24 is configured to align gas springs 28 and 30 parallel to barrel 12 on either side of barrel 12. Use of paired parallel gas springs 28 and 30 avoids binding associated with use of a single spring and avoids pitching of barrel 12 away from either spring. As with mount block 24, mount block clamps 36 or any other RMA elements may include any number of openings, recesses, chamfers and the like to reduce the weight of RMA 20 for use on robot 2.

Figure 6:
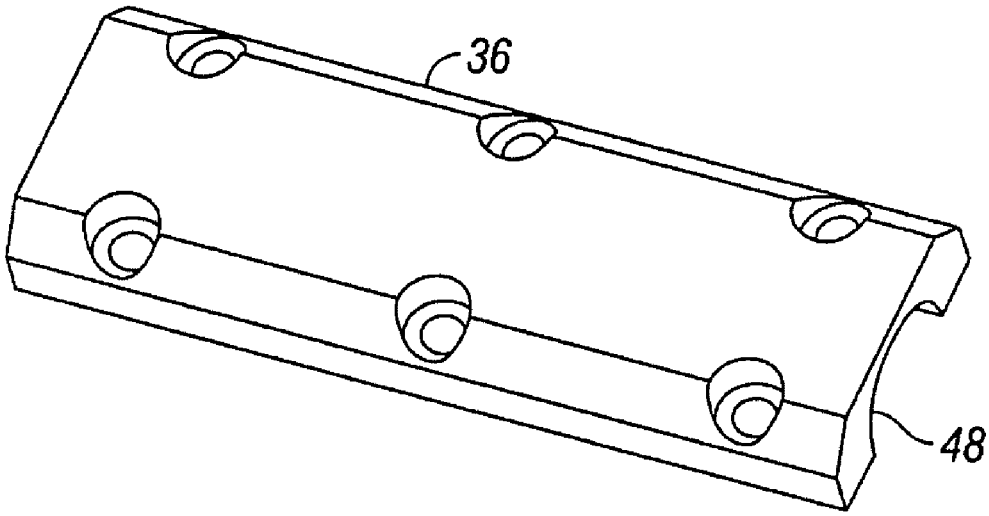
FIG. 6 is a perspective view of a robot mount block clamp.

FIG. 6 is a perspective view of a robot mount block clamp 36 defining clamp-side clamping surfaces 48 complimentary to block-side clamping surfaces 44 for securing gas springs 28 and 30. As depicted, clamp 36 can include any number of passages or other features to accommodate fastening of clamps 36 to mount block 24.

Figure 7:
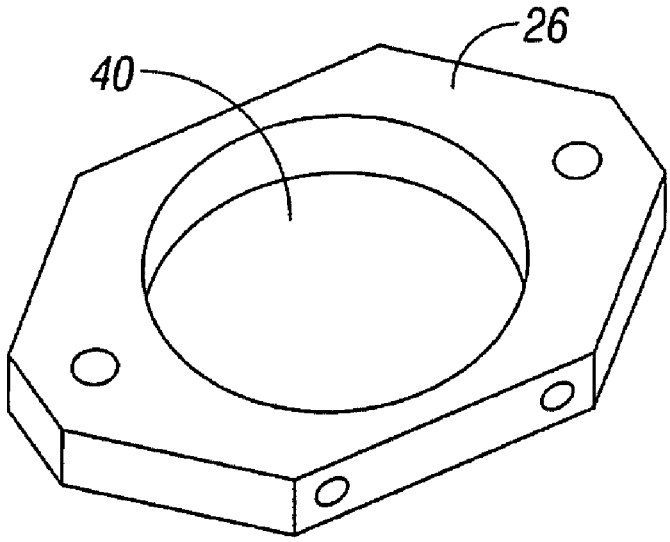
FIG. 7 is a perspective view of a barrel mounting plate for use with supplemental mounts.

FIG. 7 is a perspective view of a rearward mount plate 26 depicting barrel passage 40 and openings for attachment of gas springs 28 and 30 and support plate 38.

Figure 8:
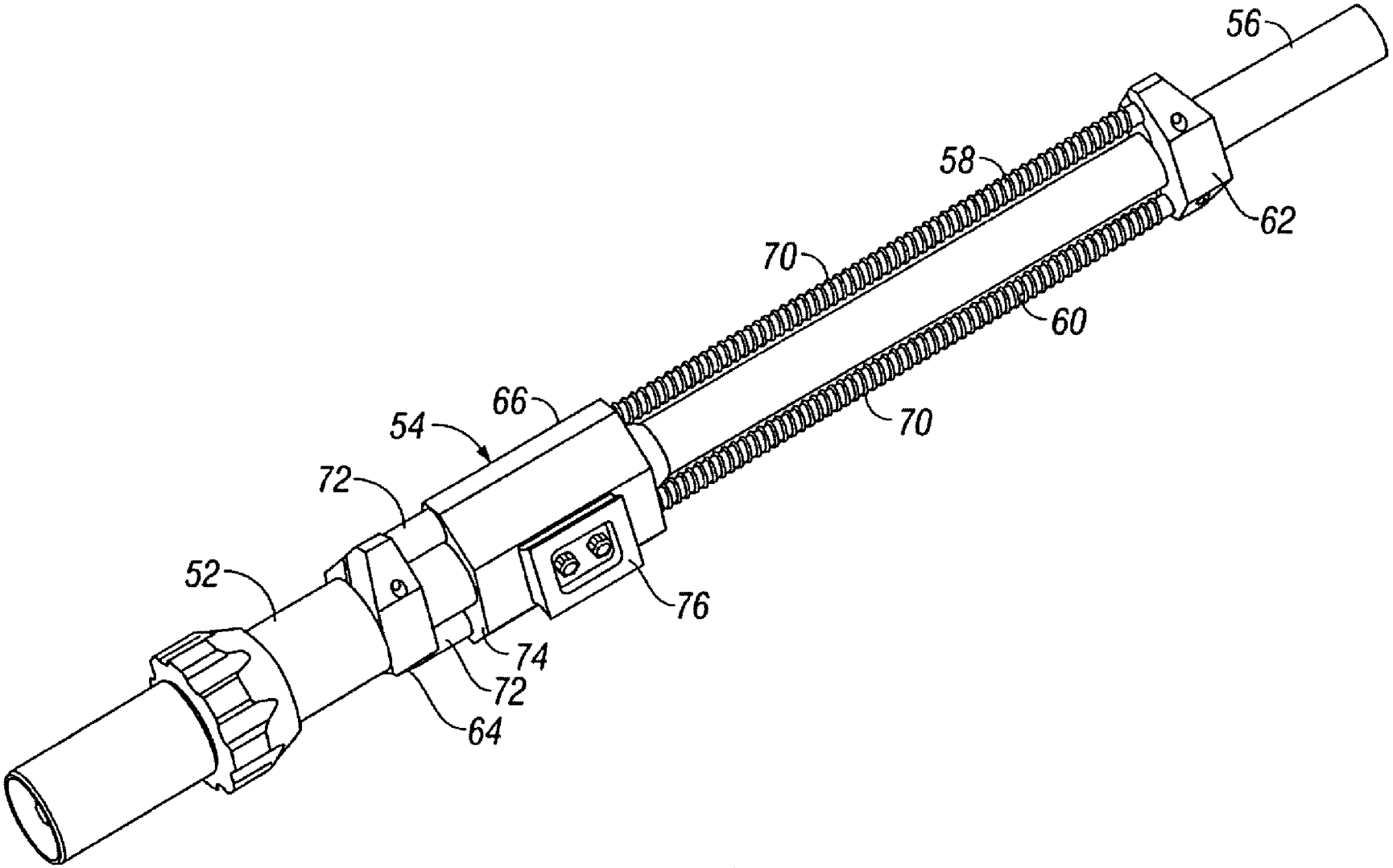
FIG. 8 is a perspective view of a disrupter and recoilless mount combination according to another embodiment.
Figure 9:
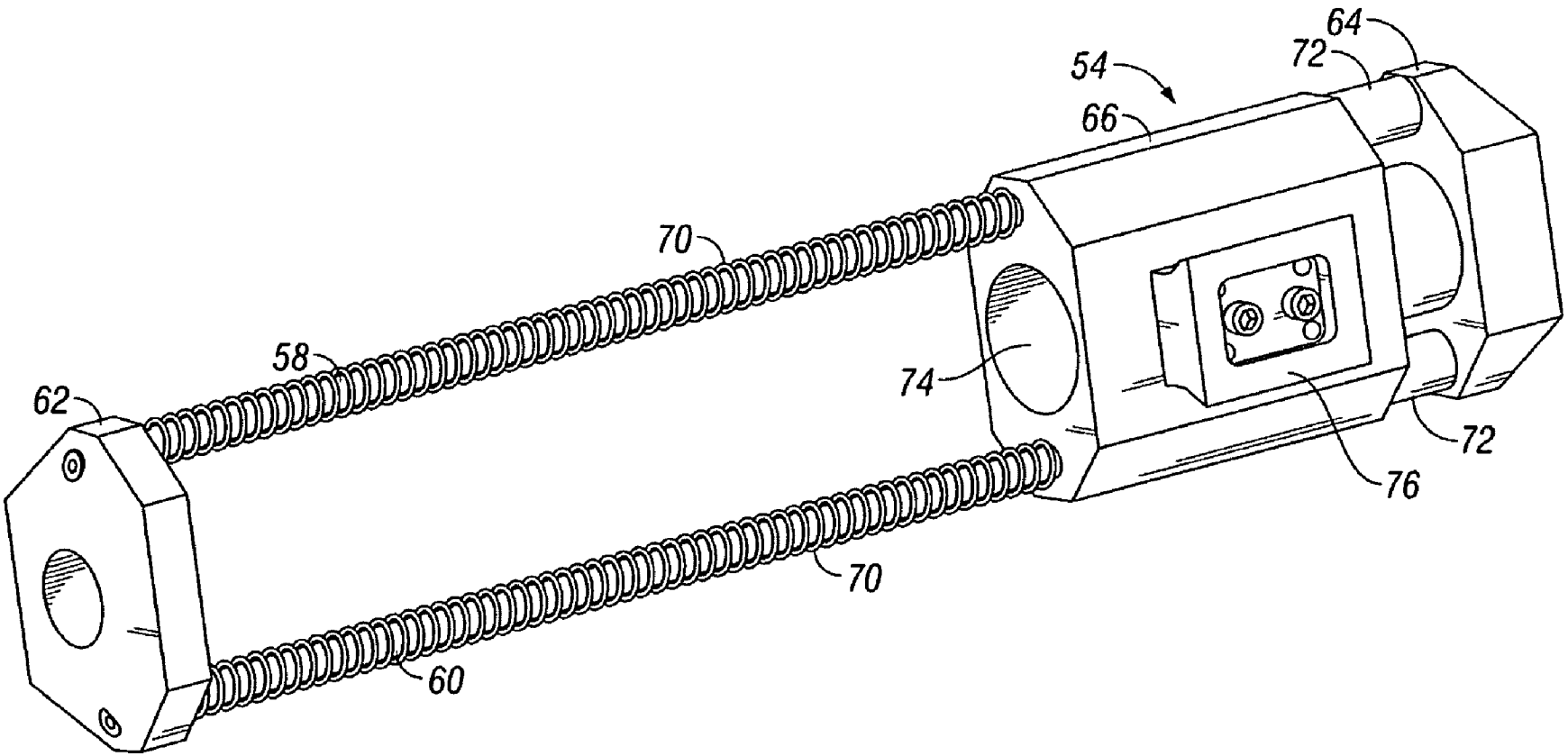
FIG. 9 is a perspective view of the recoilless mount of FIG. 8.

FIG. 8 is a perspective view of another disrupter and recoilless mount combination 50. FIG. 9 is a perspective view of the recoilless mount of FIG. 8 without an attached disrupter. Referring to FIGS. 8 and 9, in this embodiment a recoilless mount 54 carries a disrupter 52 at multiple points along the barrel 56 of disrupter 52. Recoilless mount 54 comprises first and second rails 58 and 60 attached at the forward end to barrel 56 by a forward barrel mount 62. First and second rails 58 and 60 are further attached to barrel 56 at their rearward ends by a rearward barrel mount 64. First and second rails 58 and 60 are aligned substantially parallel to and on opposite sides of barrel 56. First and second rails 58 and 60 carry a rail slider carriage 66. Carriage 66 is biased towards a first rearward position 68 by springs 70 against compliant stops 72. Carriage 66 can mount directly to robot arm 6 or can include a dove tail mount 76 for ease of attachment and removal as described earlier.

Rails 58 and 60 comprise elongated rods carrying threads or other suitable attachment mechanism for attachment to forward barrel mount 62 and rearward barrel mount 64. Rails 58-60 can comprise any metal or non-metal material having sufficient strength, stiffness and durability to perform as guides for carriage 66 under recoil loading upon firing of disrupter 52.

Recoil of disrupter 52 upon firing causes forward barrel mount 62 to compress springs 70 towards carriage 66 as rails 58 and 60 are driven rearward through carriage 66. Springs 70 can be selected to provide suitable resistance to forward movement of carriage 66 along rails 58 and 60 depending on the application. Similarly, multiple springs can be stacked in series or nested to provide varying degrees of resistance. Compliant stops 72 comprise rubber or other resilient or compliant material to suitably stop carriage 66 as it is returned to rearward position 68 springs 70. Preferably, rails 58 and 60 and springs 70 are selected to provide sufficient travel and dampening such that carriage 66 does not fully compress springs 70 during recoil, to avoid additional shocks or impulses to robotic arm 6.

Forward barrel mount 62 or rearward barrel mount 64 may comprise multiple clamping components, i.e., a clamp base and clamp cap, or may comprises unitary clamps having a closable slot other clamping feature. Accordingly, mounts 62 and 64 may be slid over barrel 56 during assembly or may be assembled around barrel 56.

Figure 10:
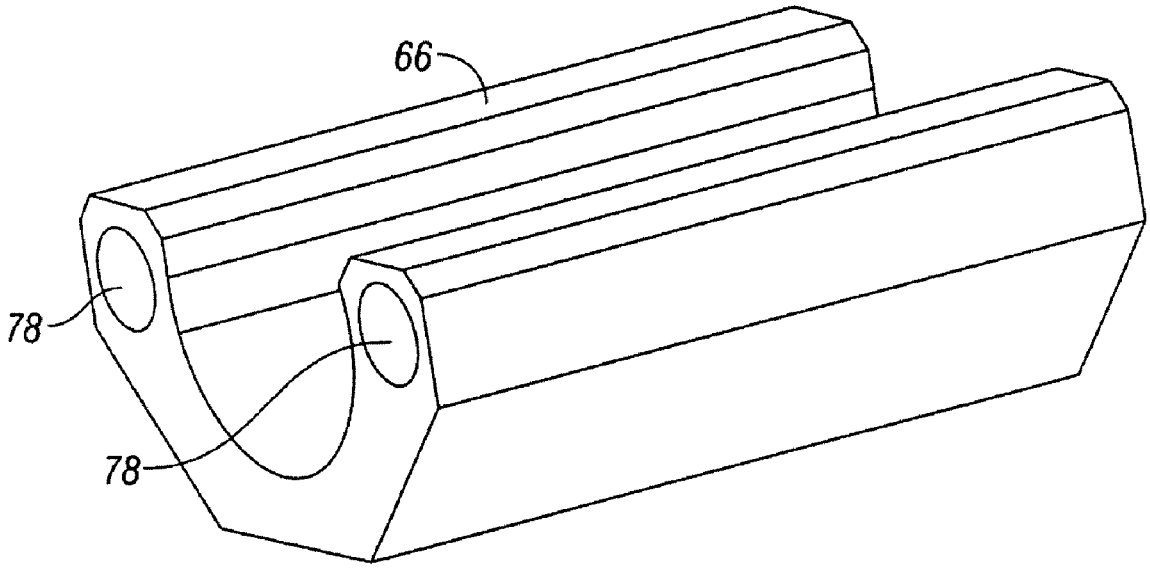
FIG. 10 is a perspective view of a rail slider carriage.

FIG. 10 is a perspective view of a rail slider carriage 66 defining rail passages 78 for sliding receipt of rails 58 and 60 and further defining barrel clearance passage 74. Carriage 66 slidably connects to rails 58 and 60 on either side of barrel 56 and defines a clearance passage 74 sized to allow longitudinal free movement of carriage 66 along barrel 56. Carriage 66 may extend between rails 58 and 60 on one or both sides of barrel 56. Accordingly, clearance passage 74 may comprises a recess or a bore carriage 66. Carriage 66 may be constructed of aluminum, steel or other structurally suitable material.

Figure 11:
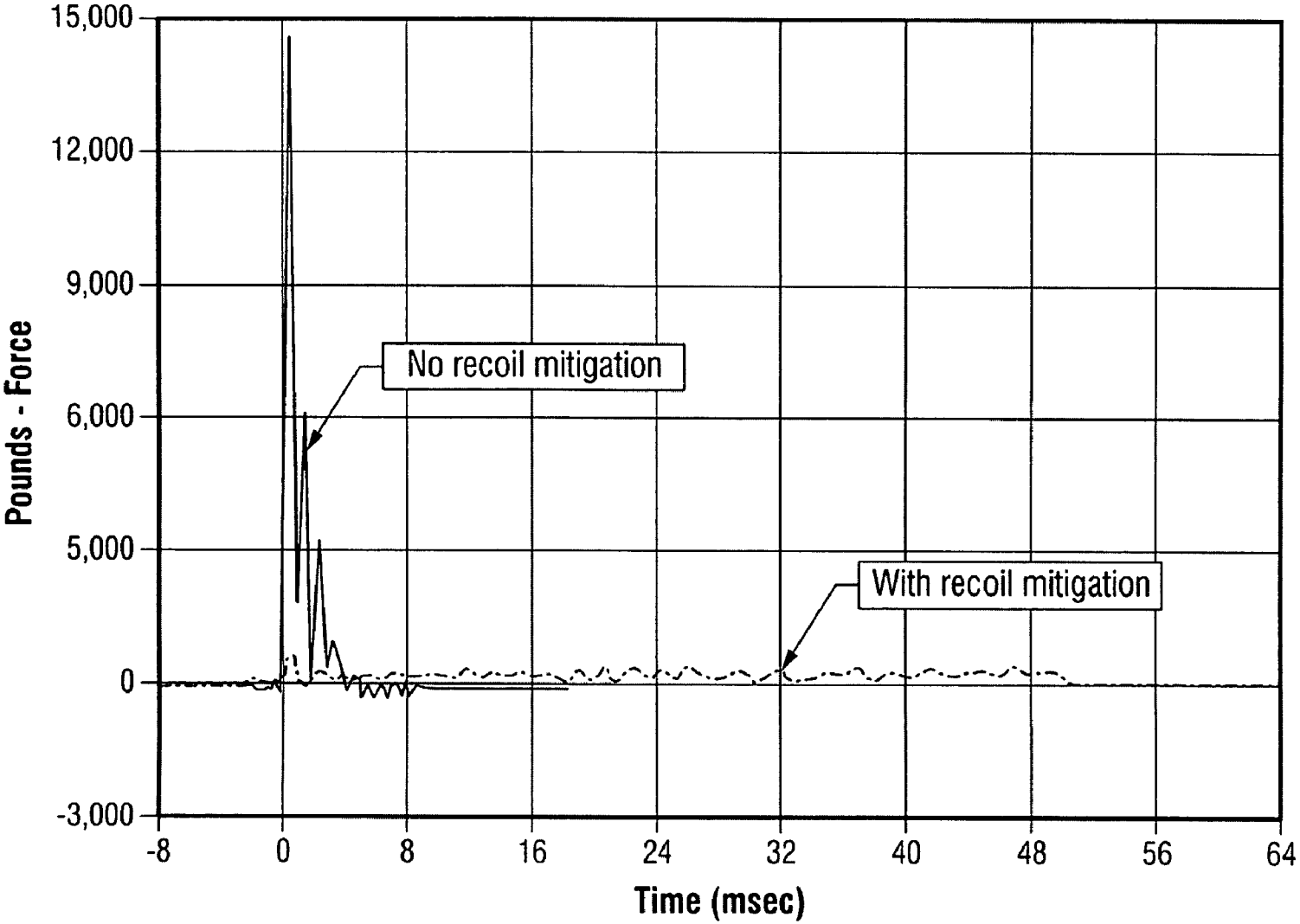
FIG. 11 is a graphical representation of recoil impulse curves for non-mitigated and mitigated disrupter discharges.

FIG. 11 is a graphical representation of recoil impulse curves for non-mitigated and mitigated disrupter discharges.

According to one embodiment, a method of mitigating recoil exerted on a robotic support platform during firing of a disrupter includes aligning a pair of spring elements in parallel with the barrel of the disrupter. The method further includes mounting a forward end of the spring elements to the barrel of the disrupter and mounting the rearward end of the spring elements to a robot mounting block attachable to the robotic support platform.

The mounting block is biased in a rearward position relative to the forward mounting point of the spring elements. The barrel recoils rearward as the disrupter is discharged, causing the spring elements to be compressed between the forward mounting point of the spring elements and the robot mounting block. The spring elements then extend the forward mounting points of the spring elements away from the robot mounting block. The spring elements may comprise gas springs, coil springs, or other mechanical, electrical or magnetic biasing device.

A number of embodiments of the invention have been described. Nevertheless, it will be understood that various modifications may be made without departing from the spirit and scope of the invention. For example, greater than two gas springs, or springs, may be employed as needed to provide greater support or recoil mitigation. Support rods and sliding carriage can be used in conjunction with the gas spring embodiment to provide greater precision or support. The invention may be adapted to be employed with alternatively configured devices having different shapes, components, materials, adjustment mechanisms, additional recoil mitigation devices and the like and still fall within the scope of the present invention. For example, additional recoil mitigation devices such as brakes, compensators, or automatic actions may also be used in combination with the present invention. Additionally, the invention is not limited to one type of EOD robot or even one class of robots. For example, the invention could be used to mitigate recoil from ordnances deployed on various aerial and nautical platforms in addition to ground terrain robots. Various attachment means have been envisioned that provide secure and rapid attachment of the invention to various attachment points of various robotic and unmanned systems. Thus, the detailed description is presented for purposes of illustration only and not of limitation. Accordingly, other variations are within the scope of the following claims.

What is claimed is:

1. A disrupter recoil mitigation device for use with a robot support platform, the device comprising:

first and second gas spring assemblies mountable in substantially parallel alignment with a barrel of a disrupter, the first and second gas spring assemblies spaced to accommodate the barrel of the disrupter between the first and second gas spring assemblies, wherein the first and second gas spring assemblies each comprise a gas cylinder and a piston rod, wherein the piston rod is slideably received within the gas cylinder, the piston rod defining a distal end extending outwardly from the gas cylinder;

a disrupter mount connected to one of the gas cylinder and the distal end of the piston rod; and a robot mount block connected to the other of the gas cylinder and the distal end of the piston rod, the robot mount block configured for mounting to a robotic support platform, wherein the robot mount block is configured to at least partially enclose the barrel of a disrupter when the disrupter is mounted between the spring elements and is further configured to permit axial disrupter movement during discharge of the disrupter.

2. The device of claim 1 wherein the disrupter mount is connectable to a forward section of a barrel of a disrupter.

3. The device of claim 1 wherein the robot mount block is connectable to a robotic arm.

4. The device of claim 1 wherein the disrupter mount comprises a barrel clamp configured to apply clamping forces to a disrupter barrel.

5. The device of claim 4 wherein the barrel clamp comprises a barrel clamp base and a barrel clamp cap, the barrel clamp base and barrel clamp cap together defining complimentary clamping surfaces.

6. The device of claim 4 wherein the robot mount block comprises opposing sides each defining a clamping surface for clamping the gas cylinder of one of the first and second gas spring assemblies, and further comprising first and second robot mount block clamps attachable to the robot mount block to secure the first and second gas spring assemblies to the robot mount block.

7. The device of claim 4 further comprising a supplemental support for supporting the first and second gas spring assemblies and spaced apart from the robot mount block to reduce pitching during discharge of the disrupter.

8. In combination, an ordnance disrupter and a disrupter recoil mitigation device, the disrupter recoil mitigation device comprising:

first and second gas spring assemblies mountable in substantially parallel alignment with a barrel of a disrupter, the first and second gas spring assemblies spaced to accommodate the barrel of the disrupter between the first and second gas spring assemblies, wherein the first and second gas spring assemblies each comprise a gas cylinder and a piston rod, wherein the piston rod is slideably received within the gas cylinder, the piston rod defining a distal end extending outwardly from the gas cylinder;

a disrupter mount connected to one of the gas cylinder and the distal end of the piston rod; and a robot mount block connected to the other of the gas cylinder and the distal end of the piston rod, the robot mount block configured for mounting to a robotic support platform, wherein the robot mount block is configured to at least partially enclose the barrel of a disrupter when the disrupter is mounted between the spring elements and is further configured to permit axial disrupter movement during discharge of the disrupter.

* * * * *